US007021788B2

(12) United States Patent
Poon

(10) Patent No.: US 7,021,788 B2
(45) Date of Patent: Apr. 4, 2006

(54) TELESCOPIC LANTERN

(75) Inventor: Tit Wing Poon, Hong Kong (CN)

(73) Assignee: Tupor Limited, Hong Kong (CN)

( * ) Notice: Subject to any disclaimer, the term of this patent is extended or adjusted under 35 U.S.C. 154(b) by 83 days.

(21) Appl. No.: 10/859,269

(22) Filed: Jun. 2, 2004

(65) Prior Publication Data

US 2005/0270772 A1 Dec. 8, 2005

(51) Int. Cl.
*F21L 4/00* (2006.01)

(52) U.S. Cl. ..... 362/186; 362/205; 362/363; 362/450; 362/802

(58) Field of Classification Search ..... 362/186, 362/205, 363, 450, 802
See application file for complete search history.

(56) References Cited

U.S. PATENT DOCUMENTS

| | | | | |
|---|---|---|---|---|
| 5,758,949 | A | 6/1998 | Van Deursen | 362/186 |
| 6,030,094 | A | 2/2000 | Sedovic et al. | 362/203 |
| 6,305,820 | B1 * | 10/2001 | Poon | 362/186 |

* cited by examiner

*Primary Examiner*—John Anthony Ward
*Assistant Examiner*—Mark Tsidulko
(74) *Attorney, Agent, or Firm*—Alix, Yale & Ristas, LLP

(57) ABSTRACT

A lantern includes a base assembly, a light assembly and a globe assembly that is telescopically movable, relative to the base assembly, from a collapsed OFF position to an extended ON position. The base assembly includes a housing having an upper platform and a pair of electrical contacts connected to a power supply within the base assembly. The light assembly includes a socket guide, a socket member, an actuating element, a socket support and a spring. The socket guide has an upper plate having a pair of electrical contacts mounted on the upper plate top face. The socket member has a socket segment for receiving the base of a lighting element, an extension segment extending downward through an opening in the socket guide upper plate, and a pair of electrical contacts electrically connected with the lighting element. The actuating element extends from a lower end portion, engaged with the socket guide upper plate top face, through an opening in the upper platform of the base assembly housing to an upper end. The socket support is fixedly mounted to the base assembly housing and has lower plate and an extension element extending upward to an upper end portion engaged with a lower end portion of the socket member extension segment. The spring extends from an upper end, engaged with the bottom face of the socket guide upper plate, to a lower end, engaged with top face of the socket support lower plate.

14 Claims, 7 Drawing Sheets

TELESCOPIC LANTERN

BACKGROUND OF THE INVENTION

This invention relates generally to a lantern. More particularly, the present invention relates to a collapsible, waterproof lantern.

Early conventional collapsible lanterns generally included a candle or wick, which provides a flame as a light source. A transparent globe surrounding the light source telescoped from a storage position to an operating position but the candle or wick did not. More recent conventional collapsible lanterns have replaced the candle/wick with a light bulb that is powered by batteries stored within the lantern. U.S. Pat. No. 5,768,949 and U.S. Pat. No. 6,030,094 disclose a collapsible lantern having a globe and cap telescopingly mounted to a base. A light bulb is mounted in the globe and is electrically connected to batteries that are mounted in the base. The relative movement between the globe/cap/light bulb assembly and the base/battery assembly requires an electrical path that is relatively complicated and expensive to manufacture.

SUMMARY OF THE INVENTION

Briefly stated, the invention in a preferred form is a telescopic lantern having an electrically powered lighting element for providing illumination. The lantern comprises a base assembly, a globe assembly and a light assembly. The base assembly includes a housing having an upper platform, with an opening, and a pair of electrical contacts. A power supply disposed within the base assembly is in electrical communication with the base assembly electrical contacts. The globe assembly is telescopically movable, relative to the base assembly, from a collapsed OFF position to an extended ON position. The light assembly includes a socket guide, a socket member, an actuating element, a socket support and a spring. The socket guide has an upper plate, having top and bottom faces and a central opening, and a pair of electrical contacts mounted on the upper plate top face. The socket member has a socket segment for receiving the base of the lighting element, an extension segment extending downward from the socket segment, through the opening of the socket guide upper plate, to a lower end portion, and a pair of electrical contacts for electrically connecting with the lighting element. The actuating element extends from a lower end portion, engaged with the socket guide upper plate top face, through the upper platform opening of the base assembly housing to an upper end. The socket support is fixedly mounted to the base assembly housing and has lower plate having a top face and an extension element extending upward from the lower plate top face to an upper end portion. The upper end portion of socket support extension element engages the lower end portion of the socket member extension segment to mount the socket member in a fixed position relative to the base assembly. The spring extends from an upper end, engaged with the bottom face of the socket guide upper plate, to a lower end, engaged with top face of the socket support lower plate. The lantern is turned on by extending the globe assembly from the OFF position to the on position by pulling the globe assembly away from the base assembly, the spring force of the light assembly spring urging the socket guide and the actuating element away from the socket support. The socket guide electrical contacts contact the socket member electrical contacts and the base assembly electrical contacts, establishing an electrical connection between the socket member and the power supply to energize the lighting element mounted in the socket member. The lantern is turned off by collapsing the globe assembly from the ON position to the OFF position by pushing the globe assembly toward the base assembly. The globe assembly engages the upper end of the actuating element, whereby the pushing force overcomes the spring force of the light assembly spring and the globe assembly urges the actuating element and socket guide toward the socket support. The socket guide electrical contacts lose contact with the socket member electrical contacts and the base assembly electrical contacts, breaking the electrical connection between the socket member and the power supply to de-energize the lighting element mounted in the socket member.

The base assembly housing also includes a substantially cylindrical guide member, coaxial with the upper platform opening, extending downwardly from the base assembly housing upper platform to a lower end portion. The socket support lower plate is fixedly mounted to the lower end portion of the base assembly housing guide member. The socket guide also includes at least one wing extending downwardly from the upper plate. The socket guide wing is received within a corresponding vertically extending slot of the guide member to prevent the socket support from rotating relative to the base assembly housing as the lantern is turned on and off.

The socket guide further includes a sleeve, coaxial with the upper plate opening, extending downwardly from the upper plate. An upper end portion of the light assembly spring is received within the socket guide sleeve.

The actuating element is a refractive sleeve surrounding the socket member and a lighting element having mounted in the socket member socket segment. The socket guide upper plate has a lip, coaxial with and adjacent to the upper plate opening, extending upwardly from the upper plate top face. The socket guide lip is received within the lower end portion of the refractive sleeve. Preferably, the lower end portion of the refractive sleeve is removably mounted to the socket guide lip by a bayonet joint.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
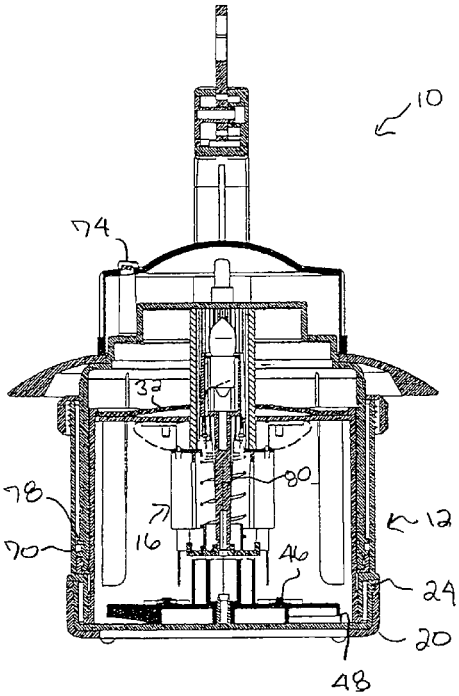
FIG. 1 is a cross-sectional view of a lantern in accordance with the invention, illustrating the lantern in the off position.

With reference to the drawings wherein like numerals represent like parts throughout the several figures, a lantern in accordance with the present invention is generally designated by the numeral 10. The lantern 10 includes a base assembly 12, a globe assembly 14 that is telescopically movable relative to the base assembly 12, and a light assembly 16.

Figure 2:
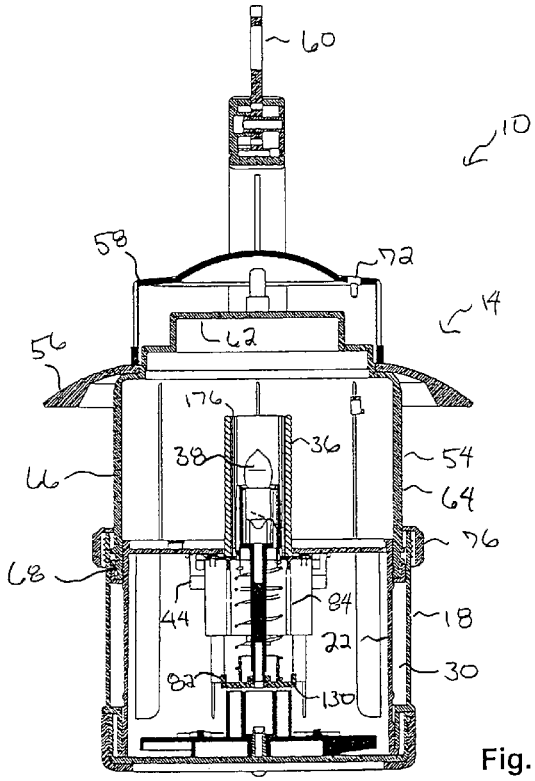
FIG. 2 is a cross-sectional view of the lantern of FIG. 1, illustrating the lantern in the on position.
Figure 3:
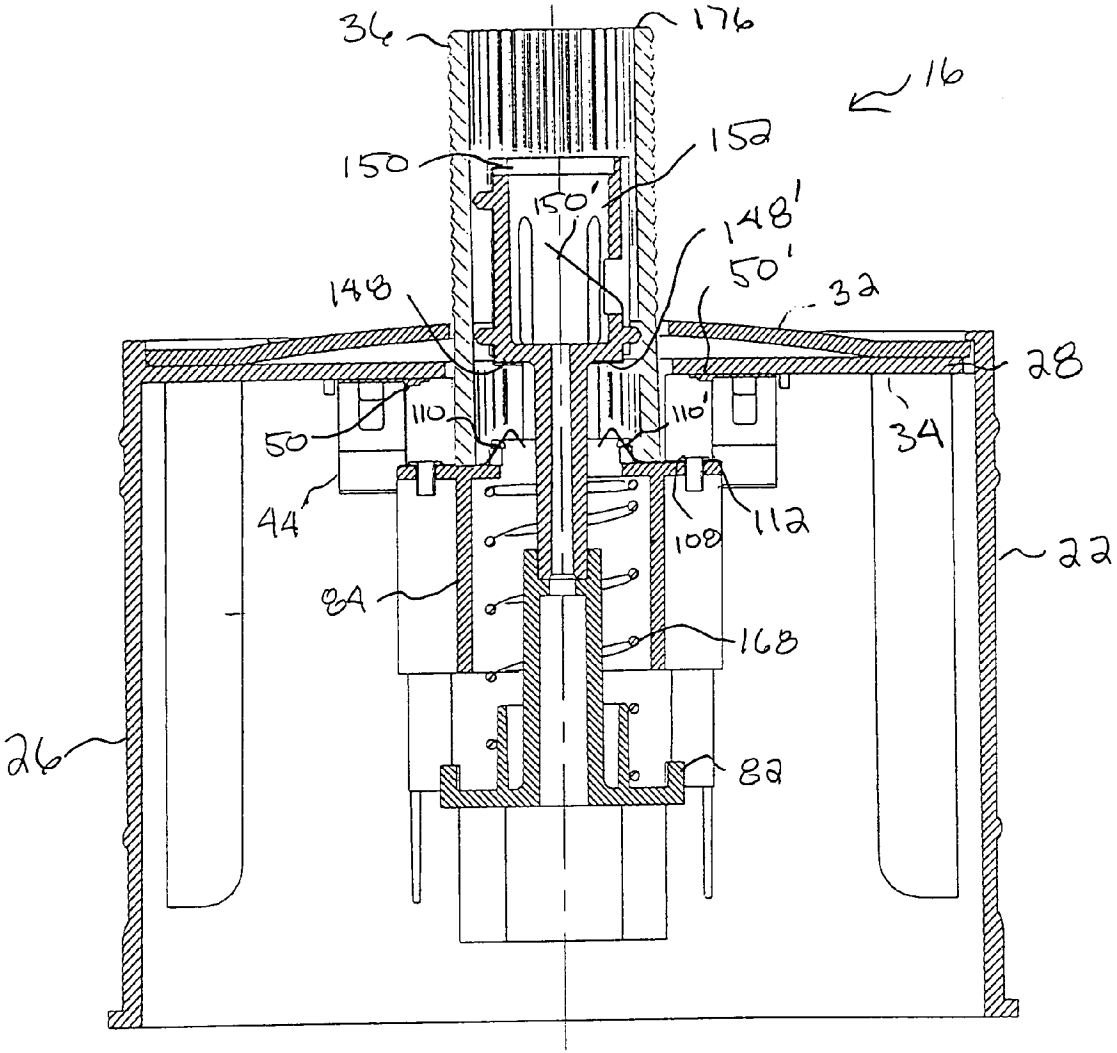
FIG. 3 is an enlarged cross-sectional view of the inner housing and light assembly of the lantern of FIG. 1.
Figure 5:
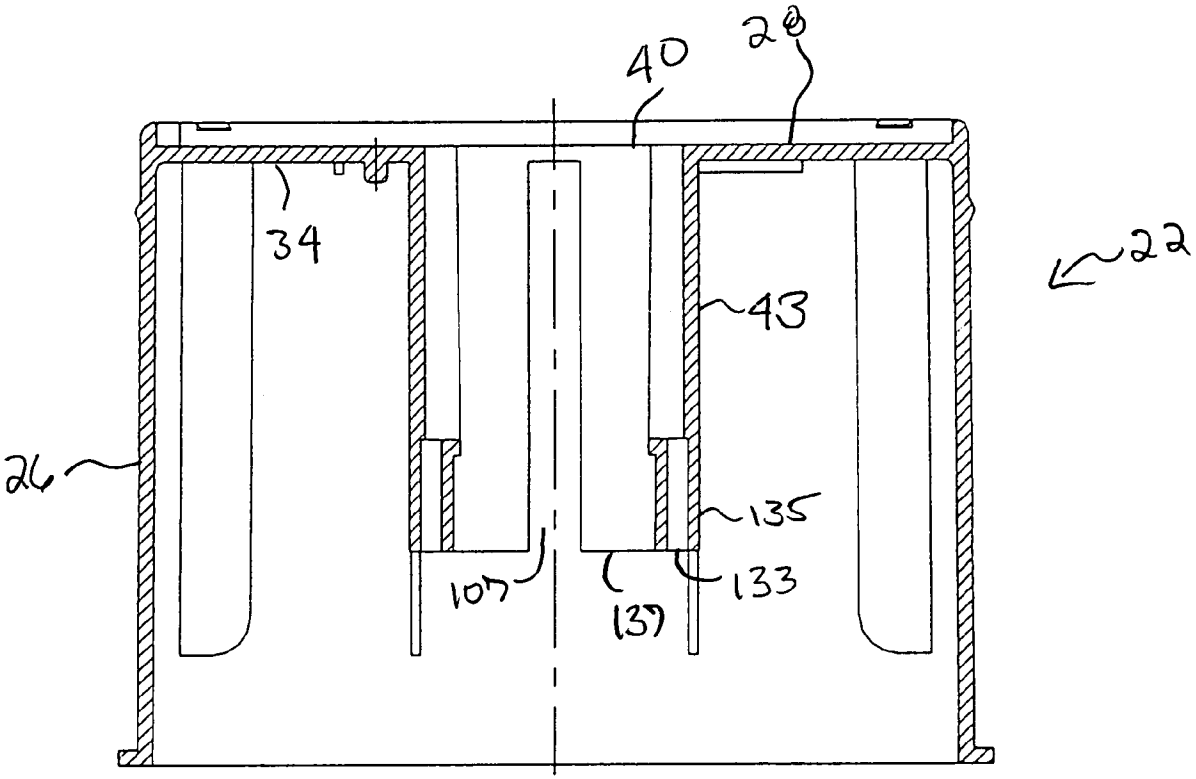
FIG. 5 is an enlarged cross-sectional view of the inner housing of FIG. 1.

With reference to FIGS. 1 and 2, the base assembly 12 includes a cylindrical outer housing 18, a bottom member 20, and an inner housing 22 disposed within the outer housing 18. The outer housing 18 and the cup-shaped bottom member 20 form an outer shell of the base. The threaded inner surface of the rim of the bottom member 20 engages the threaded outer surface of the lower portion of the outer housing 18 to mount the bottom member 20 to the outer housing 18. An O-ring 24 disposed between the bottom member 20 and the outer housing 18 provides a waterproof seal. The inner housing 22 includes a cylindrical skirt 26 that extends downwardly from an upper platform 28 (FIG. 3). The outer diameter of the inner housing skirt 26 is smaller than the inner diameter of the outer housing 18, forming an annular space 30 between the outer housing 18 and the inner housing skirt 26. A reflecting plate 32 having a conically-shaped inner segment may be mounted on the upper face of the inner housing upper platform 28. The light assembly 16 is mounted to the lower face 34 of the inner housing upper platform 28, with a refractive sleeve 36 and a light bulb 38 of the light assembly 16 extending upwardly through axial openings 40, 42 in the inner housing upper platform 28 and the reflecting plate 32. A substantially cylindrical guide member 43 (FIG. 5) that is coaxial with opening 40 and extends downwardly from lower face 34 guides movement of the socket guide 84 of the light assembly 16, as explained in greater detail below.

Power for the light bulb 38 is supplied by batteries (not shown), preferably conventional D cell batteries, which extend axially between the light assembly 16 and the inner housing skirt 26. Battery electrical contacts 44, 46 mounted on the lower face 34 of the inner housing upper platform 28 and the upper face 48 of the bottom member 20 fix the batteries in place and electrically connect the batteries to form a single power supply. The power supply is electrically connected to power supply electrical contacts 50, 50' mounted on the lower face 34 of the inner housing upper platform 28 by battery electrical contacts 44, 46. The power supply electrical contacts 50, 50' are contacted by the light assembly 16 to provide power to the light bulb 38, as explained in detail below. The bottom member 20 may be temporarily removed to replace the batteries.

The globe assembly 14 includes a globe 54, a decorative shade 56, a top cover 58, and a handle 60. The globe 54 includes a cap 62 and a cylindrical side wall 64 that has upper, middle and lower portions. The top cover 58 is mounted to the globe cap 62. The middle and lower portions 66, 68 of the side wall 64 are axially movable within the annular space 30 between the inner and outer housings 22, 18. The globe assembly 14 may be extended/telescoped to the on position (FIG. 2) such that only the lower portion 68 of the globe side wall 64 remains within the base annular space 30. Alternatively, the globe assembly 14 may be inserted to the off position (FIG. 1) such that the middle and lower portions 66, 68 of the globe side wall 64 are disposed within the base annular space 30. An O-ring 70 disposed between the globe side wall 64 and the base outer housing 18 provides a waterproof seal between the base assembly 12 and the globe assembly 14 for all positions of the globe assembly 14.

The globe assembly 14 is vented by an opening 72 in the top cover 58 to allow air to enter the globe 54 as the globe assembly 14 is extended to the on position and to allow air to exit the globe 54 as the globe assembly 14 is inserted to the off position. It should be appreciated that the waterproof seal between the globe and base assemblies 14, 12 would make it extremely difficult to move the globe assembly 14 relative to the base assembly 12 in the absence of such a vent. A plug 74 is inserted into the opening/vent 72 after the globe assembly 14 is completely extended or inserted to seal the vent 72, making the lantern 10 completely waterproof.

A connecting ring 76 is threadably mounted on the outside surface of the upper portion of the base outer housing 18 and engages a rim 78 positioned intermediate the middle and lower portions 66, 68 of the globe side wall 64 when the globe assembly 14 is extended to the on position to prevent the lower portion 68 of the globe side wall 64 from being withdrawn from the base annular space 30.

Figure 8:
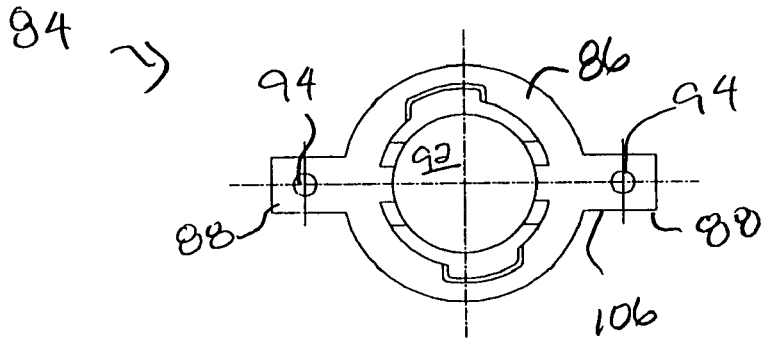
FIG. 8 is an enlarged top view of the socket guide of the light assembly of FIG. 1.
Figure 9:
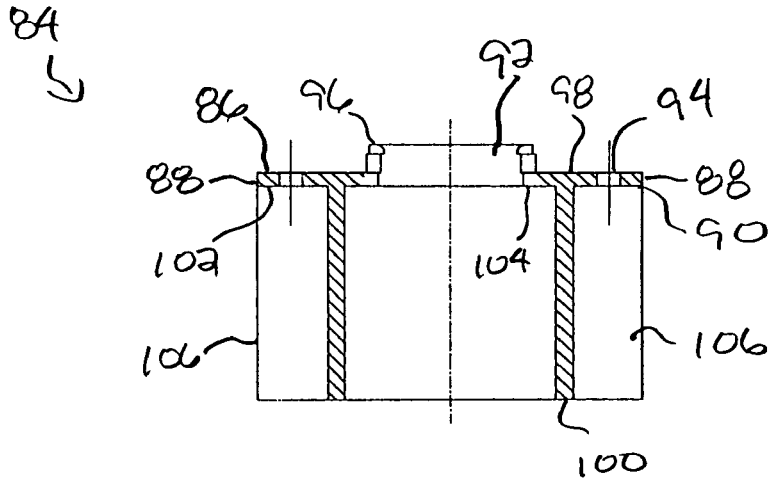
FIG. 9 is a cross-sectional view of the socket guide of FIG. 8.

The light assembly 16 includes a refractive sleeve 36, a socket member 80, a socket support 82 and a socket guide 84. With reference to FIGS. 8 and 9, the socket guide 84 includes a substantially circular upper plate 86 having oppositely disposed tabs 88 extending from the plate rim 90 and a central opening 92. Each of the tabs 88 has an opening 94 extending axially therethrough. A lip 96, coaxial with and adjacent to opening 92, extends upward from the top face 98 of upper plate 86 and a sleeve 100, coaxial with opening 92, extends downward from the bottom face 102 of upper plate 86. Sleeve 100 is radially positioned adjacent the rim 90 of upper plate 86, the portion of the upper plate bottom face 102 extending between opening 92 and sleeve 100 defining a spring engagement surface 104. Axially extending wings 106 connect the plate tabs 88 to the sleeve 100. Each wing 106 is received in a corresponding slot of the inner housing guide member 43, to prevent the socket support 82 from rotating relative to the inner housing 22 as the lantern 10 is turned on and off. Electrical leads 108 connect electrically conductive spring elements 110, 110' to electrical contacts 112 mounted on the top face 98 of upper plate 86. Preferably, electrical contacts 112 are mounted to the socket guide 84 by rivets extending through the tab openings 94. The spring elements 110, 110' extend axially upward from top face 98 and radially inward through openings in lip 96 into opening 92, providing a resiliently flexible, electrically conductive structure.

Figure 6:
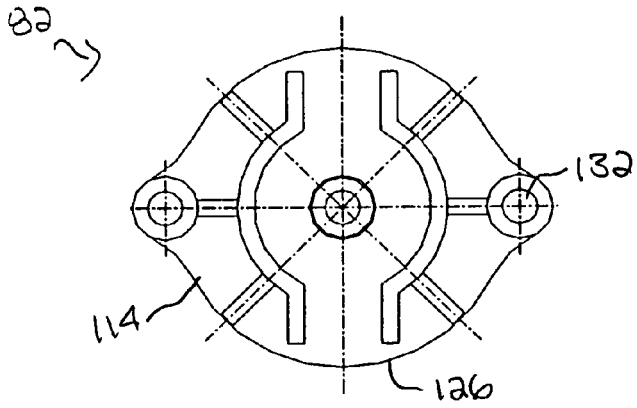
FIG. 6 is an enlarged bottom view of the of the socket support of the light assembly of FIG. 1.
Figure 7:
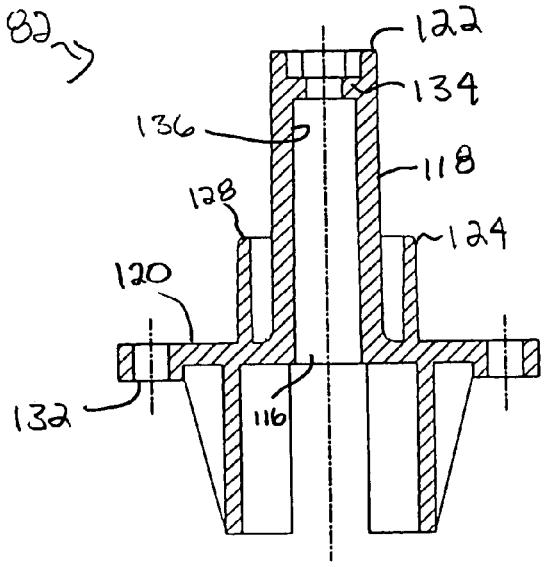
FIG. 7 is a cross-sectional view of the socket support of the light assembly of FIG. 6.

With reference to FIGS. 6 and 7, the socket support 82 includes a substantially circular lower plate 114 having a central opening 116. An inner sleeve 118, coaxial with and adjacent to opening 116, extends upward from the top face 120 of lower plate 114 to an upper end 122. An outer sleeve 124, coaxial with and radially positioned intermediate the inner sleeve 118 and the rim 126 of the lower plate 114, extends upward from the top face 120 of lower plate 114 to an upper end 128 positioned intermediate the top face 120 of lower plate 114 and the upper end 122 of inner sleeve 118. A circumferential shelf 134 extends radially inward from the inside surface 136 of inner sleeve 118. Shelf 134 is axially positioned intermediate the upper ends 122, 128 of the inner and outer sleeves 118, 124. The shelf 134 may have an orifice that is coaxial with opening 116. The threaded shafts of screws 130 extend through openings 132 in the lower plate 114 and engage bores 133 in the lower end portion 135 of inner housing guide member 43 to fixedly mount the socket support to the inner housing 22, with the lower plate top face 120 abutting the bottom face 137 of the inner housing guide member 43.

Figure 10:
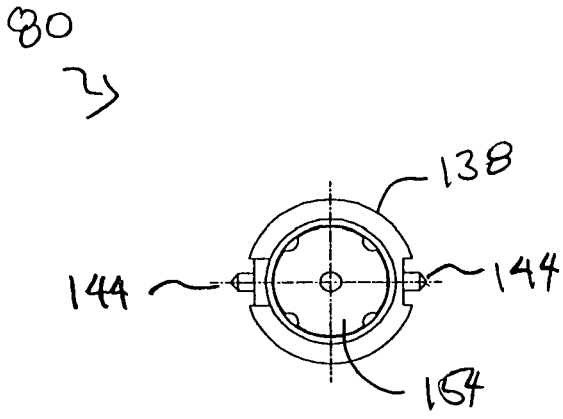
FIG. 10 is an enlarged top view of the socket member of the light assembly of FIG. 1.
Figure 11:
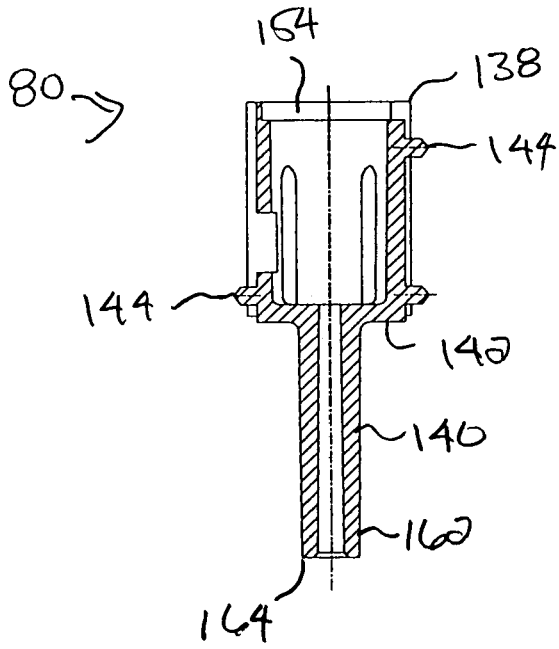
FIG. 11 is a cross-sectional view of the socket member of FIG. 10.

With reference to FIGS. 10 and 11, the socket member 80 includes an upper, cylindrical socket segment 138 and a lower, coaxial, cylindrical extension segment 140. The outside diameter of the socket segment 138 is greater than the outside diameter of the extension segment 140, creating a shoulder 142. At least one indexing pin 144 extends laterally outward from the outer surface of the socket segment 138. Electrical leads 146 connect electrical contacts 148, 148' mounted on the shoulder 142 to the electrical contacts 150, 150' of a conventional lamp socket 152 mounted in the socket segment cavity 154. Electrical contacts 150, 150' contact the base of a conventional light bulb 38 mounted within the lamp socket 152, for supplying electrical power to the light bulb light element, as explained below.

Figure 4:
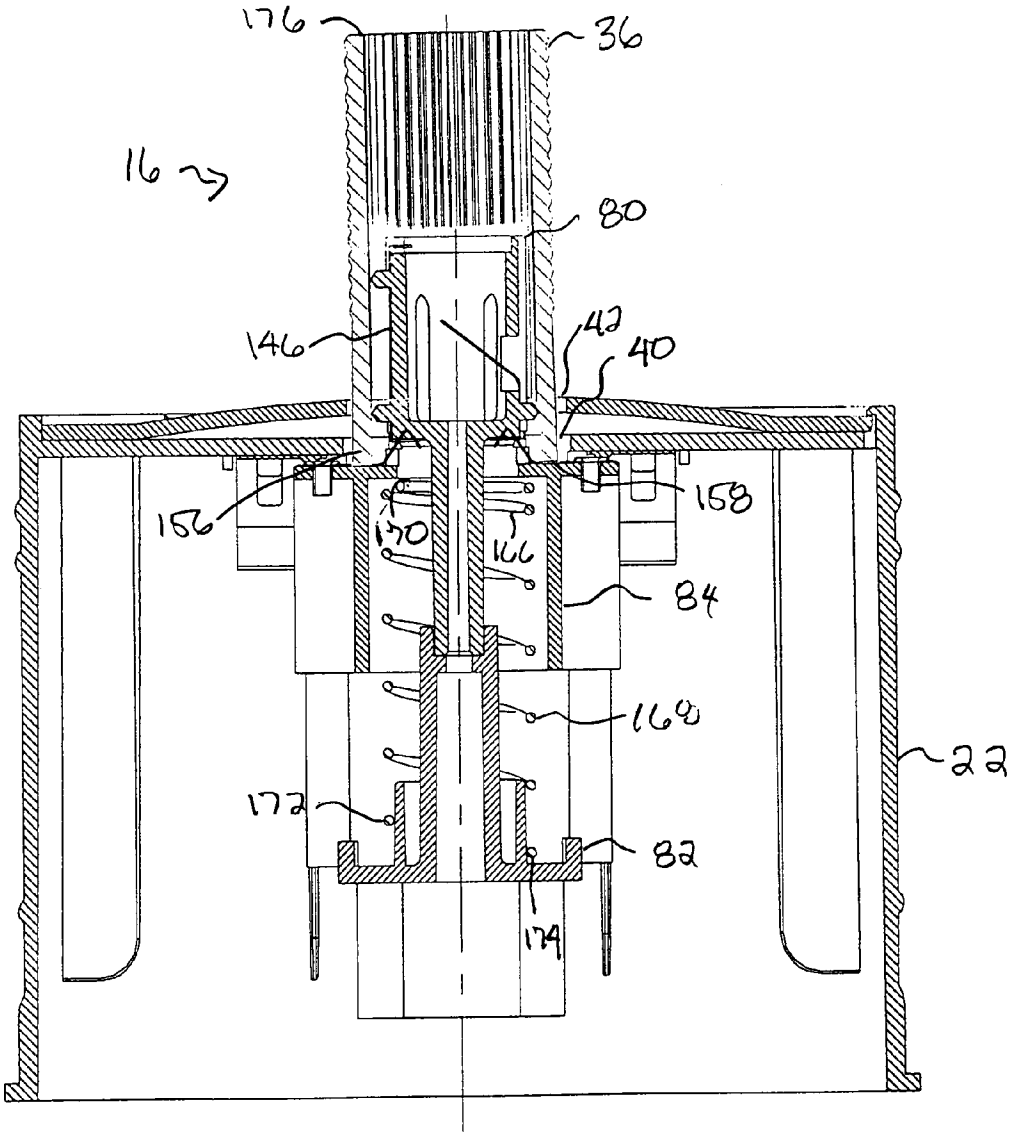
FIG. 4 is an enlarged cross-sectional view of the inner housing and light assembly of the lantern of FIG. 2.

With further reference to FIGS. 3 and 4, the refractive sleeve 36 extends through the reflecting plate axial opening 42 and the inner housing upper platform axial opening 40 to a lower end portion 156. The upper plate lip 96 is received within and mounted to the lower end portion 156 of the refractive sleeve 36, with the lower end 158 of the refractive sleeve 36 engaging the upper plate top face 98. Preferably, the lower end portion 156 of the refractive sleeve 36 is removably mounted to the upper plate lip 96 by a bayonet joint to facilitate changing the light bulb 38. The upper end portion 160 of the socket support 82 is mounted to the inner housing upper platform 28, such that the socket support inner sleeve 118 and the socket guide opening 92 are coaxial and a portion of the socket support inner sleeve 118 is positioned within the socket guide sleeve 100. The socket guide skeleton structure 106 and the socket support skeleton structure 132 are aligned such that the socket guide 84 is axially movable relative to the socket support 82. The socket member socket segment 138 is positioned within the refractive sleeve 36, with the socket member extension segment 140 extending axially downward through the socket guide opening 92 into the socket guide sleeve 100. The lower end portion 162 of the socket member extension segment 140 is received within and mounted to the socket support inner sleeve 118, with the extension segment lower end 164 engaging the inner sleeve shelf 134, such that the socket support 82 mounts the socket member 80 in a fixed position relative to the base assembly inner housing 22. The upper end portion 166 of a helical compression spring 168 is disposed within the socket guide sleeve 100, with the spring upper end 170 engaging the socket guide spring engagement surface 104 and the socket support outer sleeve 124 is received within the spring lower end portion 172, with the spring lower end 174 engaging the top face 120 of the socket support lower plate 114. The compression spring 168 biases the socket guide 84 and the refractive sleeve 36 mounted thereon away from the socket support 82 and the socket member 80 mounted thereon.

To turn a lantern 10 off and place it out of service, the plug 74 is removed from the vent 72, the base bottom member 20 is placed on a surface and the handle 60 is grasped by hand (or alternatively the handle 60 and base assembly 12 are grasped by hand), and the globe assembly 14 is inserted to the off position by pushing the globe side wall middle portion 66 into the base annular space 30. Movement of the globe assembly 14 is resisted by a retarding force exerted by the contact of the O-ring seal 70 with the base outer housing 18 and the globe side walls 64 until the refractive sleeve upper end 176 contacts the globe cap 62. At that point, the pushing force exerted on the globe assembly 14 must additionally overcome the spring force of compression spring 168 as the globe assembly 14 urges the refractive sleeve 36 and socket guide 84 toward the socket support 82. As the globe assembly 14 is further pushed toward the off position and the socket guide 84 is pushed toward the socket support 82, the socket guide spring elements 110, 110' initially elastically return to an extended condition and then loose contact with the socket member electrical contacts 148, 148', breaking the electrical connection between the light bulb 38 and the power supply. When the globe assembly 14 has been completely pushed to the off position (FIGS. 1 and 3), the plug 74 is inserted into the vent 72. The O-ring retarding force, is sufficient to hold the globe assembly 14 in the off position against the spring force of compression spring 168. In addition, any movement of the globe assembly 14 (with the plug 74 installed in the vent 72) would cause a vacuum to form within the globe 54 that would preclude movement of any significant amount.

To place the lantern 10 in use, the plug 74 is removed from the vent 72, the handle 60 and base assembly 12 are grasped by hand, and the globe assembly 14 is extended to the on position by pulling the globe side wall middle portion 66 out of the base annular space 30. Initially, the spring force of compression spring 168 aids the pulling force in overcoming the retarding force applied by the O-ring seal 70, urging the socket guide 84 and refractive sleeve 36 away from the socket support 82. As the socket guide 84 approaches the socket member socket segment 138, the socket guide spring elements 110, 110' will come into contact with the socket member electrical contacts 148, 148', establishing an electrical connection between the light bulb 38 and the power supply. As the globe assembly 14 is pulled to the point where the refractive sleeve upper end 176 loses contact with the globe cap 62, the socket guide spring elements 110, 110' are elastically flexed toward the socket guide upper plate 86, ensuring that good electrical contact between the socket guide spring elements 110, 110' and the socket member electrical contacts 148, 148' is maintained. After the refractive sleeve upper end 176 loses contact with the globe cap 62, the pulling force is not aided by the spring force of compression spring 168 in overcoming the O-ring retarding force. When the globe assembly 14 has been completely extended to the on position (FIGS. 2 and 4), the plug 74 is inserted into the vent 72. The O-ring retarding force is sufficient to hold the globe assembly 14 in the on position. In addition, any movement of the globe assembly 14 (with the plug 74 installed in the vent 72) would cause a pressure to form within the globe 54 that would preclude movement of any significant amount.

It should be appreciated that as the lantern 10 is placed in use or out of service, the light bulb 38 remains in a fixed position relative to the base assembly 12 while the refractive sleeve 36 and the socket guide 84 move axially up or down, respectively, relative to the base assembly 12. Such construction allows the use of a relatively simple switch device to make and break the electrical connection between the light bulb 38 and the power source. Specifically, simple mechanical contact between the socket member electrical contacts 148, 148' and the socket guide spring elements 110, 110' is sufficient to make the electrical connection between the light bulb 38 and the power supply and removing the mechanical contact between the socket member electrical contacts 148, 148' and the socket guide spring elements 110, 110' is sufficient to break the electrical connection between the light bulb 38 and the power supply.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telescopic lantern having a lighting element powered by a power supply disposed within the lantern, the lighting element having a base and a light source, the lantern comprising:

a base assembly including a housing having an upper platform defining an opening and a pair of electrical contacts adapted for providing electrical communication with the power supply;

a globe assembly that is telescopically movable, relative to the base assembly, from a collapsed OFF position to an extended ON position;

a light assembly including a socket guide having an upper plate, having top and bottom faces and defining a central opening, and a pair of electrical contacts mounted on the upper plate top face;

a socket member having a socket segment adapted for receiving the base of the lighting element, an extension segment extending downward from the socket segment, through the opening of the socket guide upper plate, to a lower end portion, and a pair of electrical contacts adapted for electrically connecting with the lighting element;

an actuating element extending from a lower end portion, engaging the socket guide upper plate top face, through the upper platform opening of the base assembly housing to an upper end;

a socket support fixedly mounted to the base assembly housing and having a lower plate having a top face and an extension element extending upward from the lower plate top face to an upper end portion engaged with the lower end portion of the socket member extension segment, whereby the socket support mounts the socket member in a fixed position relative to the base assembly; and a spring extending from an upper end, engaged with the bottom face of the socket guide upper plate, to a lower end, engaged with top face of the socket support lower plate;

wherein the lantern is turned on by extending the globe assembly from the OFF position to the on position by pulling the globe assembly away from the base assembly, the spring force of the light assembly spring urging the socket guide and the actuating element away from the socket support, whereby the socket guide electrical contacts contact the socket member electrical contacts and the base assembly electrical contacts, whereby an electrical connection is established between a power supply disposed within the base assembly and a lighting element mounted in the socket member to energize the lighting element; and the lantern is turned off by collapsing the globe assembly from the ON position to the OFF position by pushing the globe assembly toward the base assembly, the globe assembly engaging the upper end of the actuating element, whereby the pushing force overcomes the spring force of the light assembly spring and the globe assembly urges the actuating element and socket guide toward the socket support, and the socket guide electrical contacts lose contact with the socket member electrical contacts and the base assembly electrical contacts, breaking the electrical connection between the socket member and the power supply, whereby a lighting element mounted in the socket member is de-energized.

2. The telescopic lantern of claim 1 wherein each of the electrical contacts of the socket guide includes a base electrical contact and an electrically conductive spring element extending upwardly from the upper plate top face and laterally from the base electrical contact.

3. The telescopic lantern of claim 1 wherein the base assembly housing also includes a substantially cylindrical guide member, coaxial with the upper platform opening, extending downwardly from the base assembly housing upper platform to a lower end portion, the guide member defining at least one vertically extending slot, and the socket guide also includes at least one wing extending downwardly from the upper plate, the at least one socket guide wing being received within the at least one guide member slot to prevent the socket support from rotating relative to the base assembly housing as the lantern is turned on and off.

4. The telescopic lantern of claim 3 wherein the socket guide further includes a sleeve, coaxial with the upper plate opening, extending downwardly from the upper plate, an upper end portion of the light assembly spring being received within the socket guide sleeve.

5. The telescopic lantern of claim 1 wherein the base assembly housing also includes a substantially cylindrical guide member, coaxial with the upper platform opening, extending downwardly from the base assembly housing upper platform to a lower end portion, the socket support lower plate being fixedly mounted to the lower end portion of the base assembly housing guide member.

6. The telescopic lantern of claim 1 wherein the actuating element is a refractive sleeve adapted for surrounding the socket member and a lighting element having a base mounted in the socket member socket segment, and the socket guide upper plate also has a lip, coaxial with and adjacent to the upper plate opening, extending upwardly from the upper plate top face, the socket guide lip being received within the lower end portion of the refractive sleeve.

7. The telescopic lantern of claim 6 wherein the lower end portion of the refractive sleeve is removably mounted to the socket guide lip by a bayonet joint.

8. The telescopic lantern of claim 1 wherein the socket support extension element comprises a sleeve extending upwardly within the light assembly spring and the socket member extension segment comprises a cylinder extending downwardly within the light assembly spring.

9. The telescopic lantern of claim 8 wherein socket support sleeve has an inside surface defining a bore and a circumferential shelf extending radially inward from the inside surface, the lower end portion of the socket member cylinder being received within the bore of the upper end portion of the socket support sleeve and engaging the shelf of the socket support sleeve.

10. A telescopic lantern comprising:

a base assembly including a housing having an upper platform defining an opening and a pair of electrical contacts;

a power supply disposed within the base assembly and in electrical communication with the base assembly electrical contacts;

a globe assembly that is telescopically movable, relative to the base assembly, from a collapsed OFF position to an extended ON position;

a light assembly including a socket guide having an upper plate, having top and bottom faces and defining a central opening, a sleeve extending downward from the upper plate bottom face to a lower end portion, and a pair of electrical contacts mounted on the upper plate top face;

a socket member having a socket segment, an extension segment extending downward from the socket segment, through the opening of the socket guide upper plate, to a lower end portion, and a pair of electrical contacts;

a light bulb having a base mounted in the socket member socket segment and in electrical communication with the electrical contacts of the socket member, and a light source disposed above the socket member;

a refractive sleeve extending from a lower end portion, engaging the socket guide upper plate top face, through the upper platform opening of the base assembly housing to an upper end, the refractive sleeve surrounding the socket member and the light bulb and being vertically moveable relative to the socket member and the light bulb;

a socket support fixedly mounted to the upper platform of the base assembly housing and having a lower plate having a top face and a sleeve extending upward from the lower plate top face to an upper end portion engaged with the lower end portion of the socket member extension segment, whereby the socket support mounts the socket member in a fixed position relative to the base assembly; and a spring extending from an upper end, engaged with the bottom face of the socket guide upper plate, to a lower end, engaged with top face of the socket support lower plate;

wherein the lantern is turned on by extending the globe assembly from the OFF position to the on position by pulling the globe assembly away from the base assembly, the spring force of the light assembly spring urging the socket guide and the refractive sleeve away from the socket support, whereby the socket guide electrical contacts contact the socket member electrical contacts and the base assembly electrical contacts, establishing an electrical connection between the light bulb and the power supply, and the lantern is turned off by collapsing the globe assembly from the ON position to the OFF position by pushing the globe assembly toward the base assembly, the globe assembly engaging the upper end of the refractive sleeve, whereby the pushing force overcomes the spring force of the light assembly spring and the globe assembly urges the refractive sleeve and socket guide toward the socket support, and the socket guide electrical contacts lose contact with the socket member electrical contacts and the base assembly electrical contacts, breaking the electrical connection between the light bulb and the power supply.

11. The telescopic lantern of claim 10 wherein the light assembly spring is a helical compression spring surrounding the socket member extension segment and the socket support sleeve, an upper end portion of the light assembly spring is disposed within the socket guide sleeve.

12. The telescopic lantern of claim 10 wherein each of the electrical contacts of the socket guide includes a base electrical contact and an electrically conductive spring element extending upwardly from the upper plate top face and laterally from the base electrical contact.

13. The telescopic lantern of claim 10 wherein the base assembly housing also includes a substantially cylindrical guide member, coaxial with the upper platform opening, extending downwardly from the base assembly housing upper platform to a lower end portion, the socket support lower plate being fixedly mounted to the lower end portion of the base assembly housing guide member.

14. The telescopic lantern of claim 13 wherein the socket guide also includes at least one wing extending downwardly from the upper plate, the at least one socket guide wing being received within a corresponding vertically extending slot of the guide member to prevent the socket support from rotating relative to the base assembly housing as the lantern is turned on and off.

* * * * *